US007178687B1

(12) United States Patent
Manderfield, Jr. et al.

(10) Patent No.: US 7,178,687 B1
(45) Date of Patent: Feb. 20, 2007

(54) MOLDABLE PLASTIC CONTAINER WITH HOURGLASS PROFILE

(75) Inventors: Grover John Manderfield, Jr., Mt. Prospect, IL (US); Ted L. Beaver, Roselle, IL (US)

(73) Assignee: Consolidated Container Company LP, Atlanta, GA (US)

( * ) Notice: Subject to any disclaimer, the term of this patent is extended or adjusted under 35 U.S.C. 154(b) by 0 days.

(21) Appl. No.: 09/603,255

(22) Filed: Jun. 23, 2000

Related U.S. Application Data

(63) Continuation-in-part of application No. 09/543,949, filed on Apr. 6, 2000, now abandoned.

(51) Int. Cl.
*B65D 6/38* (2006.01)
*B65D 8/12* (2006.01)

(52) U.S. Cl. ..... 220/675; 215/375; 215/377; 215/382; 215/384; 220/628; 220/669

(58) Field of Classification Search ..... 220/628, 220/669, 666, 672, 675; D9/500, 503; D7/603, D7/302; 215/373–375, 377, 382, 384
See application file for complete search history.

(56) References Cited

U.S. PATENT DOCUMENTS

| | | | | | |
|---|---|---|---|---|---|
| 599,286 | A | | 2/1898 | McAusland | |
| D219,053 | S | | 10/1970 | Gulotta | |
| 4,040,233 | A | * | 8/1977 | Valyi | 53/440 |
| D266,135 | S | | 9/1982 | Husted | |
| D270,813 | S | * | 10/1983 | Fortuna et al. | D9/500 |
| D270,814 | S | * | 10/1983 | Edwards | D9/500 |
| 4,451,512 | A | | 5/1984 | Yazaki et al. | |
| D279,550 | S | * | 7/1985 | Fortuna | D9/500 |
| D307,238 | S | * | 4/1990 | May | D9/500 |
| 5,105,769 | A | | 4/1992 | Smith et al. | |
| 5,118,014 | A | | 6/1992 | Hestehave et al. | |
| 5,203,836 | A | | 4/1993 | Brazis et al. | |
| 5,215,794 | A | | 6/1993 | Johnson | |
| 5,234,126 | A | | 8/1993 | Jonas et al. | |
| 5,261,545 | A | * | 11/1993 | Ota et al. | 215/42 |
| 5,269,437 | A | * | 12/1993 | Gygax | 220/606 |
| 5,385,250 | A | * | 1/1995 | Pasquale | 215/374 |
| RE35,140 | E | | 1/1996 | Powers, Jr. | |
| 5,549,210 | A | | 8/1996 | Cheng | |
| 5,562,960 | A | | 10/1996 | Sugiura et al. | |
| 5,589,241 | A | | 12/1996 | Stiles et al. | |
| 5,615,790 | A | | 4/1997 | Young et al. | |
| D379,589 | S | * | 6/1997 | Rhodes et al. | D9/500 |

(Continued)

*Primary Examiner*—Nathan J. Newhouse
*Assistant Examiner*—Niki M. Eloshway
(74) *Attorney, Agent, or Firm*—Alston & Bird LLP

(57) ABSTRACT

A molded plastic container with a sidewall having a general hourglass configuration. The container structure includes an upper rim, a bottom and a sidewall that extends between the upper rim and the bottom. The sidewall includes a lower frustum section, a narrow mid-section and an upper frustum section. The lower frustum section connects the bottom to the narrow mid-section and decreases in width as it extends from the bottom to the narrow mid-section. The upper frustum section extends from the upper rim to the narrow mid-section and decreases in width as it extends from the upper rim to the mid-section. A method of making such a container, a method of hot-filling such a container and a method of retorting material enclosed in such a container are also disclosed.

15 Claims, 3 Drawing Sheets

U.S. PATENT DOCUMENTS

D381,561 S 7/1997 Manca
D383,646 S 9/1997 Jeppesen et al.
5,706,980 A * 1/1998 Dickerson ..... 222/129
5,865,345 A * 2/1999 Cistone et al. ..... 222/94
D407,608 S 4/1999 Carrere
5,900,293 A * 5/1999 Zettle ..... 220/666
5,939,153 A 8/1999 Valyi
D414,811 S * 10/1999 Base et al. ..... D9/503
5,996,882 A * 12/1999 Randall ..... 220/359.2
D422,180 S 4/2000 Sundberg
D422,218 S * 4/2000 Ohchi et al. ..... D9/503
6,062,408 A 5/2000 Beck et al.
6,085,924 A 7/2000 Henderson
6,112,925 A 9/2000 Nahill et al.
6,129,803 A 10/2000 Kester
D438,116 S * 2/2001 Nosella ..... D9/500
6,213,326 B1 * 4/2001 Denner et al. ..... 215/383
6,237,791 B1 5/2001 Beck et al.
D447,418 S * 9/2001 Bezek et al. ..... D9/500
D454,190 S 3/2002 Trocola
6,472,007 B2 * 10/2002 Bezek et al. ..... 426/115

* cited by examiner

MOLDABLE PLASTIC CONTAINER WITH HOURGLASS PROFILE

RELATED APPLICATION DATA

This application is a continuation-in-part of U.S. application Ser. No. 09/543,949 filed Apr. 6, 2000, now abandoned, the entirety of which is incorporated herein by reference for all purposes and priority is claimed to said application.

FIELD OF THE INVENTION

The present invention generally relates to shallow molded plastic containers. More specifically, the present invention relates to a plastic container that is blow molded, inj ection molded or injection blow molded. Further, the present invention relates to methods for hot-filling and retorting such containers.

BACKGROUND OF THE INVENTION

Shallow plastic molded containers are known. However, molded containers with irregular sidewalls that either bulge outward or inward are not generally known because it is difficult to extract such a container in an axial direction from a mold because of the engagement of the irregular sidewall against portions of the mold that correspond to the top or bottom of the container body.

Further, while plastic hot-fill containers and plastic retort containers are known, plastic hot-fill containers and plastic retort containers are configured to be deformable or to include expansion members to accommodate volumetric changes of the contents during the cooling of a hot-fill container or during the heating of a retort container. As a result, rigid containers for hot-fill and retort applications are not generally available.

Still further, consumer demand requires that new product designs and shapes be constantly developed. This consumer demand also applies to containers such as molded plastic containers. Further, manufacturers are constantly trying to distinguish their products from their competition by creating unique and different packaging, including uniquely designed containers. As a result, there is a need for a moldable plastic container with irregular sidewalls that will present an aesthetically appealing and unique configuration in contrast to prior art molded plastic containers. Containers presenting different and new configurations would be useful to distinguish the products sold in such containers from competing products. Finally, there is a need for molded containers having unique designs that are both rigid and suitable for hot-fill and retort processing.

SUMMARY OF THE INVENTION

The above needs are inventively met by the present invention which provides a plastic molded container that comprises a bowl which includes an upper rim, a bottom and an irregularly shaped sidewall that extends between the upper rim and the bottom. In a preferred embodiment, the sidewall comprises a lower frustum section, a narrow mid-section and an upper frustum section. The lower frustum section connects the bottom of the bowl to the mid-section of the sidewall. The lower frustum section decreases in width as it extends from the bottom of the bowl to the mid-section of the sidewall. In contrast, the upper frustum section connects the upper rim of the bowl to the mid-section of the sidewall. The upper frustum section is upside down or decreases in width as the upper frustum section extends from the upper rim of the bowl to the mid-section of the sidewall.

In an embodiment, the plastic molded container of the present invention further comprises a lid that is securable to the upper rim of the bowl.

In an embodiment, the bowl further comprises a recess disposed between the upper frustum section and the upper rim. In such an embodiment, the lid further comprises a lower lip and the recess of the bowl is adapted to receive the lower lip of the lid.

In an embodiment, the lid is rotatably securable to the rim.

In an embodiment, the container is molded from a plastic selected from the group consisting of polyvinylchloride, polyethyleneterephthalate, high density polyethylene, polycarbonate, polystyrene and polypropylene.

In an embodiment, the molded container of the present invention is blow-molded from a single layer plastic.

In an embodiment, the molded container of the present invention is blow-molded from a multi-layer plastic. In such an embodiment, the multi-layer plastic further comprises at least one gas barrier layer selected from the group consisting of polyvinylidienechloride, nylon, and ethlyenevinylalcohol copolymer.

In an embodiment, the molded container of the present invention has a diameter that is greater than its height.

In an embodiment, the bottom of the bowl of the molded container of the present invention includes a downwardly extending circular standing ridge.

In an embodiment, the present invention provides a method for forming a plastic container that comprises the following steps: providing two mold halves, each mold half having a cavity defining one-half of the container which comprises a bowl comprising an upper rim, a bottom and a sidewall extending between the upper rim and the bottom, the sidewall comprising a lower frustum section, a narrow mid-section and an upper frustum section, the lower frustum section connecting the bottom to the mid-section, the lower frustum section decreasing in width as the lower frustum section extends from the bottom to mid-section, the upper frustum section connecting the upper rim to the mid-section, the upper frustum section decreasing in width as the upper frustum section extends from the upper rim to mid-section; abutting the two mold halves together; blowing plastic material into the abutted mold halves under blow molding conditions; separating the mold halves; and extracting the resultant container.

In an embodiment, the present invention provides a method of forming a plastic container that comprises the following steps: providing a three piece mold, each mold piece having a cavity defining one-third of the container which comprises a bowl comprising an upper rim, a bottom and a sidewall extending between the upper rim and the bottom, the sidewall comprising a lower frustum section, a narrow mid-section and an upper frustum section, the lower frustum section connecting the bottom to the mid-section, the lower frustum section decreasing in width as the lower frustum section extends from the bottom to mid-section, the upper frustum section connecting the upper rim to the mid-section, the upper frustum section decreasing in width as the upper frustum section extends from the upper rim to mid-section; abutting the three mold pieces together; blowing plastic material into the abutted mold pieces under blow molding conditions; separating the mold pieces; and extracting the resultant container.

In an embodiment, the present invention provides a method of hot-filling a container that comprises the following steps: providing a plastic container comprising a bowl comprising an upper rim, a bottom and a sidewall extending between the upper rim and the bottom, the sidewall comprising a lower frustum section, a narrow mid-section and an upper frustum section, the lower frustum section connecting the bottom to the mid-section, the lower frustum section decreasing in width as the lower frustum section extends from the bottom to mid-section, the upper frustum section connecting the upper rim to the mid-section, the upper frustum section decreasing in width as the upper frustum section extends from the upper rim to mid-section; positioning the container within a receptacle; filling the container with material under hot filling conditions; sealing the container with a suitable seal member; and securing a lid on the container.

In an embodiment, the present invention provides a method of retorting material disposed within a container that comprises the following steps: providing a plastic container comprising a bowl comprising an upper rim, a bottom and a sidewall extending between the upper rim and the bottom, the sidewall comprising a lower frustum section, a narrow mid-section and an upper frustum section, the lower frustum section connecting the bottom to the mid-section, the lower frustum section decreasing in width as the lower frustum section extends from the bottom to mid-section, the upper frustum section connecting the upper rim to the mid-section, the upper frustum section decreasing in width as the upper frustum section extends from the upper rim to mid-section; positioning the container within a receptacle; filling the container with material under ambient or near ambient conditions; securing a lid on the container; sealing the container with a suitable seal member; heating the container, material, lid and seal member.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the present invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
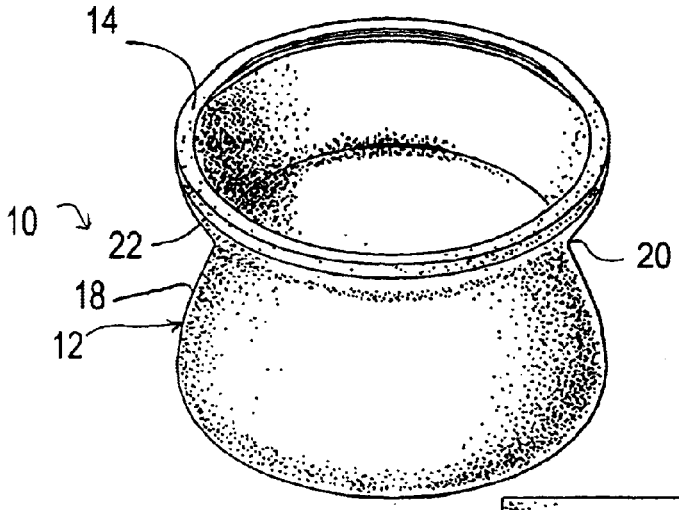
FIG. 1 is a perspective view of a container made in accordance with the present invention.
Figure 2:
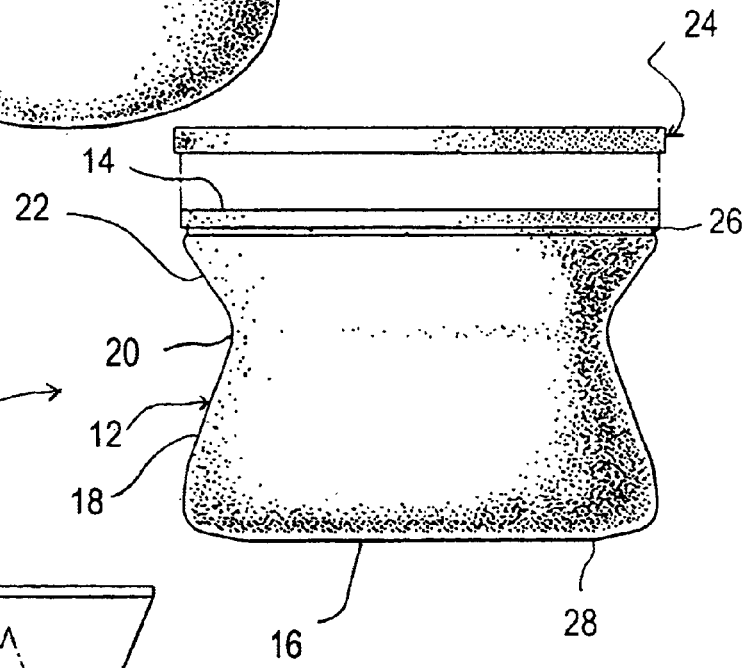
FIG. 2 is a side elevational view of the container shown in FIG. 1 and a lid made in accordance with the present invention.
Figure 3:
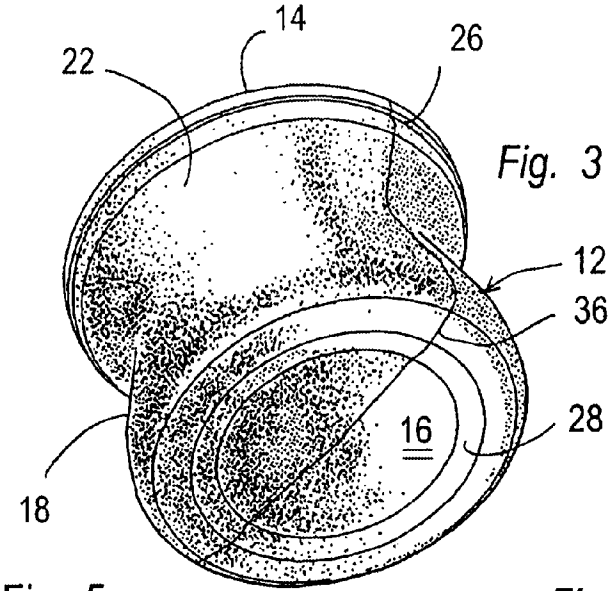
FIG. 3 is a bottom perspective view of the container shown in FIGS. 1 and 2 and further illustrating a mold parting line for a two-piece mold.

As illustrated in FIGS. 1–3, a container 10 embodying the principles of the present invention includes a bowl portion 12 which has a general hourglass configuration and that extends between an upper rim 14 and a bottom 16. The sidewall 12 includes a lower frustum section 18, a mid-section 20 and an upper frustum section 22. The lower frustum section 18 connects the bottom 16 to the mid-section 20 and is upright, or, in other words, decreases in width or diameter as it extends from the bottom 16 to the mid-section 20. The upper frustum section 22 connects the upper rim 14 to the mid-section 20. In contrast to the lower frustum section 18, the upper frustum section 20 is inverted, or, in other words, decreases in width or diameter as it extends from the upper rim 14 to the mid-section 20. In the embodiment illustrated in FIGS. 1–3, the upper frustum section 22 is shorter than the lower frustum section 18.

As illustrated in FIG. 2, the container 10 may also be equipped with a conventional lid 24 that is equipped with an inwardly protruding lip (not shown) that is received in the recess 26 disposed between the upper rim 14 and the upper frustum section 22. As illustrated in FIGS. 2 and 3, the bottom 16 may be equipped with a circular standing ridge 28 that provides a secure and stable support for the container 10 on a flat surface (not shown).

As may be appreciated from the figures, the container 10 has a maximum width defined by the upper rim 14 or a lower portion of the lower frustum section 18 that is greater than the overall height of the container 10 as measured from the bottom 16 to the top of the upper rim 14.

Figure 4:
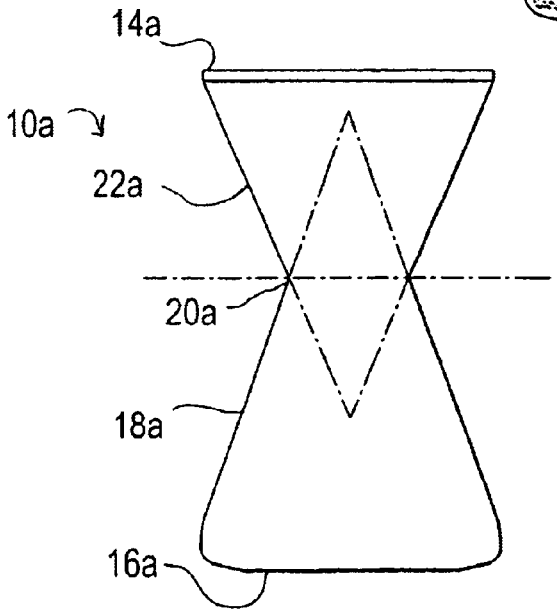
FIG. 4 is a schematic view illustrating the upper and lower frustum sections of the container design of the present invention.

Referring to FIG. 4, the relationship between the upper frustum section 22*a* and lower frustum section 18*a* is illustrated in greater detail. The container design 10*a* consists essentially of two opposing frustum sections, the downwardly extending upper frustum section 22*a* and the upwardly extending lower frustum section 18*a*. The inner section of the two frustums is represented by the mid-section 20*a*. As a result, the container 10*a* exhibits a general hourglass configuration.

Figure 6:
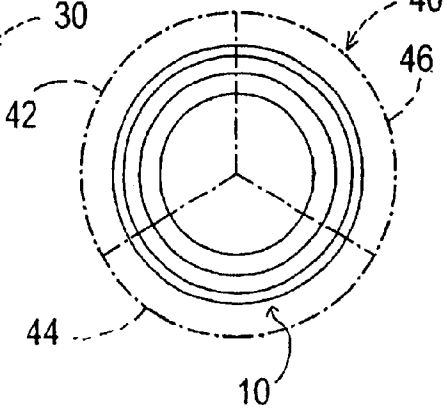
FIG. 6 illustrates, schematically, a bottom plan view of a container made in accordance with the present invention and surrounded to three mold pieces of a three-piece mold illustrated by broken lines.
Figure 5:
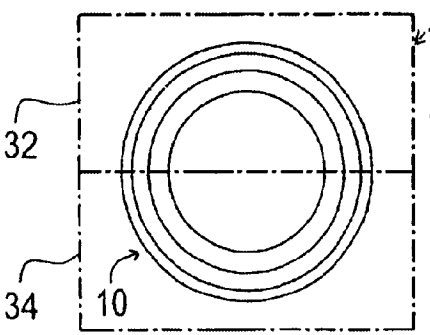
FIG. 5 illustrates, schematically, a bottom plan view of a container made in accordance with the present invention and surrounded by mold halves illustrated by broken lines.

The container 10 of the present invention can be molded from a two piece mold 30 illustrated schematically in FIG. 5 and which includes mold halves 32, 34. The mold halves 32, 34 create the parting line 36 illustrated in FIG. 3. In contrast, the container 10 can be molded from a three-piece mold 40 which includes mold sections 42, 44 and 46 as illustrated in FIG. 6.

Figure 7:
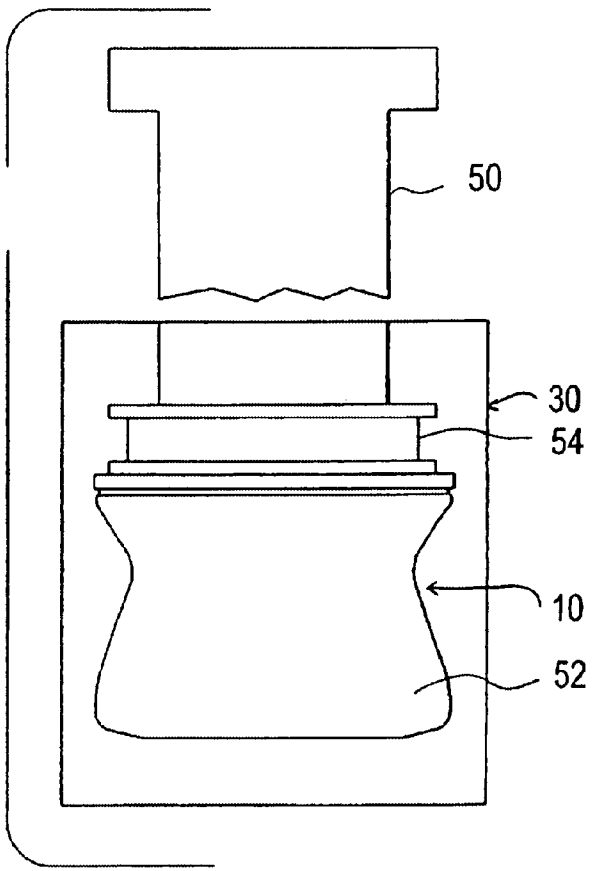
FIG. 7 illustrates, schematically, the interior of a mold half and a compressed gas needle used to blow gas into the interior of a parison used to form a container made in accordance with the present invention.

Referring to FIG. 7, the presently preferred method for forming the container 10 includes the use of plastic parison material 50 that is captured in a cavity 52 defined by the two mold halves 32, 34 illustrated in FIG. 5. Compressed gas is blown into the mold 30 to force the parison material 50 against the walls of the cavity 52 defined by the mold halves 32, 34. The container 10 is then formed in the normal manner with the appropriate cooling steps, such as liquid cooling to set the shape of the plastic material. When the container 10 is completed, the mold halves 32, 34 are separated and the container 10 is ejected or released.

Blow molding is well known to those skilled in the art and reference can be made to U.S. Pat. Nos. 4,457,855 and 4,990,382, which are incorporated herein by reference.

As illustrated in FIG. 4, a spin trim dome or a blow dome 54 can be formed at the top of the container 10. The dome 54 can then be removed during further processing.

Further, each mold half 32, 34 can further define a second cavity (not shown) for simultaneously molding a second container (not shown). The second cavity can be molded 180-degrees opposed to the first container 10 and connected to the first container across the dome 54. After extraction of the connected containers, the containers can then be separated at the area comprising the dome 54 and the remnants of the dome 54 can be removed from the respective containers.

The plastic material parison 50 can comprise a single layer plastic or a multi-layer plastic. The plastic can be chosen from any suitable material, including but not limited to polyvinylchloride, polyethyleneterephthalate, high density polyethylene, polycarbonate, polystyrene and polypropylene plastic materials which are particularly suited for containers 10 having cold fill food items. Further, a multi-layer plastic may be used which has a barrier layer, such as an oxygen barrier layer, comprising, for example, a material including, but not limited to polyvinylidienechloride, nylon, and ethlyenevinylalcohol copolymer. An oxygen barrier layer is particularly suited for containers 10 having oxygen sensitive food items. As mentioned previously, in addition, a barrier quality can be provided by spray coating the molded container. Plasma deposition may also be used to create a barrier layer. In addition to oxygen, such a barrier may also be intended for odors, solvents or other gases.

The narrow mid-section 20 of the sidewall 12 provides an area for which it is easy for a user to grip the container 10. The mid-section 20 provides an indentation in which normal sized adult fingers can fit thereby enabling a more secure grip about the mid-section 20 as the upper and lower frustum sections 22, 18 respectively will hinder the container 10 for moving upward or downward relative to the fingers. This is particularly useful when the exterior of the container 10 is wet due to sweating or condensation or when the container 10 is hot.

The container 10 can be filled with any suitable material. In a preferred embodiment, the container 10 is suitable for food products, such as, for example, salsa, beans, cheese or sauces. The container 10 can be filled with material by cold-fill or hot-fill processes or, the container 10 can be used in a retort process as well. The container 10 is equally adaptable for or usable in such varied processes/applications because of the inherent integrity and sturdiness provided by the overall shape of the container 10. With this hourglass-like shape, the walls resist paneling and other deformations during a retort process in which items are first sealed in the container prior to being subjected to a heating process followed by a cooling process.

After the container 10 is filled with a suitable material, the upper rim 14 of the container can be sealed with a suitable sealing member such as a film or foil which is bonded to the upper rim 14. In the alternative, an overseal (not shown) can be placed over the lid 24. The overseal can be formed over the lid 14, recess 26 and a portion of the upper frustum section 22 and secured in place by a shrink wrap process. A sealing member secured to the upper rim 14 can comprise any conventional sealing material, such as, for example, a single layer or multiple layer foil.

For retort processes, the container 10 can be filled with material at an ambient temperature or an elevated temperature for materials where it is desired to reduce the viscosity of the material for handling or filling purposes.

Figure 9:
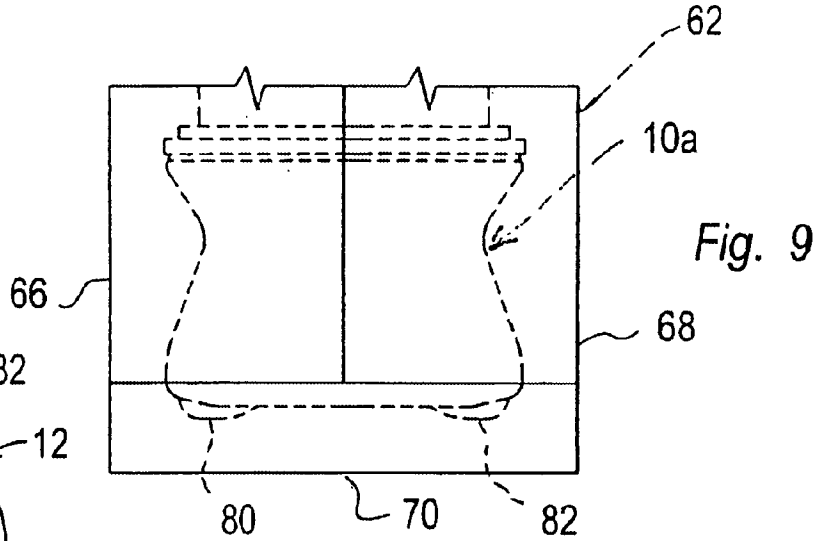
FIG. 9 illustrates, schematically, a side plan view of a container made in accordance with the present invention and surrounded by mold lines for a three-piece mold.
Figure 10:
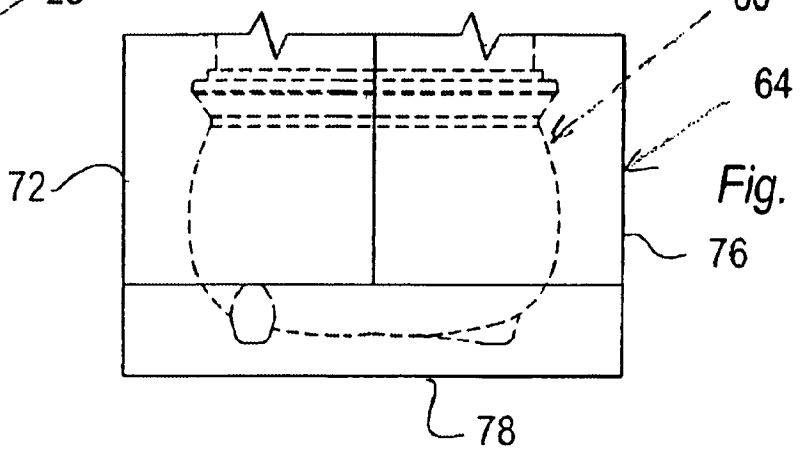
FIG. 10 illustrates, schematically, a side plan view of an alternative container surrounded by a three-piece mold.
Figure 8:
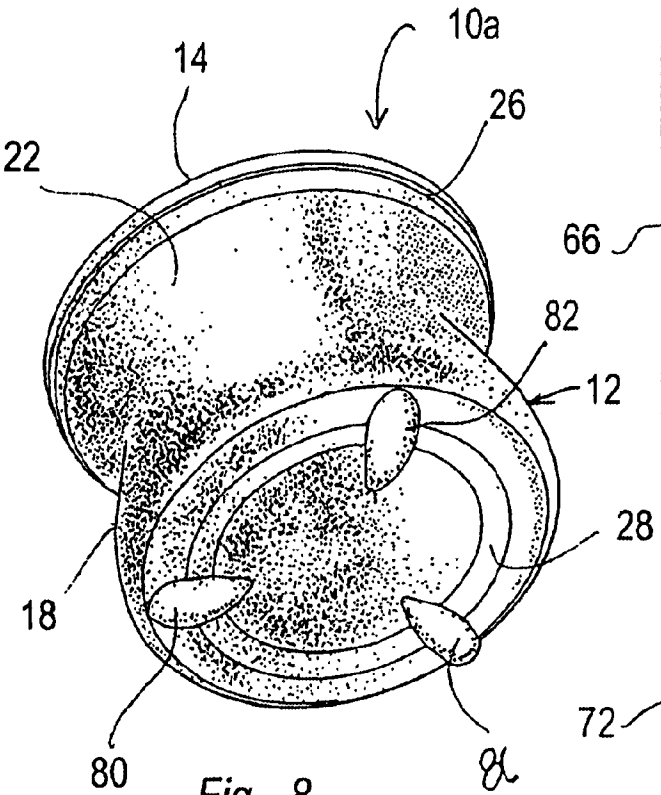
FIG. 8 is a bottom perspective view of an alternative embodiment of the container made in accordance with the present invention.

Again, while a two mold formation has been discussed and shown, containers of this type can be made using more than two mold parts, e.g., three or four mold sections. Specifically, FIGS. 9 and 10 illustrate alternative containers 10*a* and 60 respectively that are both surrounded by three-piece molds 62, 64 respectively. Specifically, the three-piece mold 62 includes upper sections 66, 68 and lower section 70. The three-piece mold 64 includes upper sections 72, 76 and lower section 78. The container 10*a* is fitted with three bottom feet 80, 82 and 86 as further illustrated in FIG. 8. All other structural features of the container 10*a* are described above with respect to FIGS. 1 and 3. The container 60 illustrated in FIG. 10 was first disclosed in U.S. patent application Ser. No. 09/543,949 filed on Apr. 6, 2000, the entirety of which is incorporated herein by reference.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A plastic molded container, comprising:

a bowl comprising an upper rim, a bottom and a sidewall extending between the upper rim and the bottom, the sidewall comprising a lower frustum section, a narrow mid-section, and an upper frustum section, the sidewall having curvilinear transitions from the upper frustum section to the narrow mid-section and from the narrow mid-section to the lower frustum section, the lower frustum section connecting the bottom to the mid-section, the lower frustum section decreasing in width as the lower frustum section extends from the bottom to mid-section, the lower frustum section having a volume larger than a volume of the upper frustum section, the upper frustum section connecting the upper rim to the mid-section, the upper frustum section decreasing in width as the upper frustum section extends from the upper rim to mid-section, the upper rim defining a maximum width of the container, and the container being constructed such that it is capable of resisting permanent deformation when used in a hot fill or retort process.

2. The plastic molded container of claim 1 further comprising a lid securable to the upper rim.

3. The plastic molded container of claim 2 further comprising a recess disposed between the upper frustum section and the upper rim, the lid further comprising a lower lip, the recess for receiving the lower lip of the lid.

4. The plastic molded container of claim 1 wherein the lid is rotatably securable to the rim.

5. The plastic molded container of claim 1 wherein the container is molded from a plastic selected from the group consisting of polyvinylchloride, polyethyleneterephthalate, high density polyethylene, polycarbonate, polystyrene and polypropylene.

6. The plastic molded container of claim 1 wherein the container is blow-molded from a single layer plastic.

7. The plastic molded container of claim 1 wherein the container is blow-molded from a multi-layer plastic.

8. The plastic molded container of claim 7 wherein said multi-layer plastic further comprises at least one gas barrier layer selected from the group consisting of polyvinylidienechloride, nylon, and ethylenevinylalcohol copolymer.

9. The plastic molded container of claim 1 wherein the container has a diameter and a height, the diameter being greater than the height.

10. The plastic molded container of claim 1 wherein the bottom comprises a downwardly extending circular standing ridge.

11. The plastic molded container of claim 1, wherein the container is a blow-molded container and includes an oxygen barrier layer.

12. The plastic molded container of claim 1, wherein the container is capable of withstanding retort conditions without significant residual distortion.

13. The plastic molded container of claim 1, wherein said sidewalls comprise a plurality of layers, one of which is an oxygen barrier layer.

14. A plastic molded container comprising:

a bowl comprising an upper rim, a bottom and sidewall extending between the upper rim and the bottom, the sidewall comprising a lower frustum section, a narrow mid-section, and an upper frustum section, the sidewall having curvilinear transitions from the upper frustum section to the narrow mid-section and from the narrow mid-section to the lower frustum section, the lower frustum section connecting the bottom to the mid-section, the lower frustum section decreasing in width as the lower frustum section extends from the bottom to mid-section, the lower frustum section having a volume larger than a volume of the upper frustum section, the upper frustum section connecting the upper rim to the mid-section, the upper frustum section decreasing in width as the upper frustum section extends from the upper rim to mid-section, the container being constructed such that it is capable of resisting permanent deformation when used in a hot fill or retort process, the upper rim defining a maximum width of the container, the sidewall being made of blow-molded materials, and the container having at least one oxygen barrier layer.

15. A plastic molded container comprising:

a bowl comprising an upper rim, a bottom and sidewall extending between the upper rim and the bottom, the sidewall comprising a lower frustum section, a narrow mid-section, and an upper frustum section, the sidewall having curvilinear transitions from the upper frustum section to the narrow mid-section and from the narrow mid-section to the lower frustum section, the lower frustum section connecting the bottom to the mid-section, the lower frustum section decreasing in width as the lower frustum section extends from the bottom to mid-section, the lower frustum section having a volume larger than a volume of the upper frustum section, the upper frustum section connecting the upper rim to the mid-section, the upper frustum section decreasing in width as the upper frustum section extends from the upper rim to mid-section, the container having a widest diameter and a height, the widest diameter being greater than the height, the upper rim defining a maximum width of the container, the container being constructed such that it is capable of resisting permanent deformation when used in a hot fill or retort process, and the sidewall having a plurality of layers, at least one of which is an oxygen barrier layer.

* * * * *

UNITED STATES PATENT AND TRADEMARK OFFICE

CERTIFICATE OF CORRECTION

PATENT NO. : 7,178,687 B1
APPLICATION NO. : 09/603255
DATED : February 20, 2007
INVENTOR(S) : Manderfield, Jr. et al.

It is certified that error appears in the above-identified patent and that said Letters Patent is hereby corrected as shown below:

Column 6,

Lines 51 and 57, after "to" insert --the--.

Column 8,

Lines 2, 8, 26, and 32, after "to" insert --the--.

Signed and Sealed this

Twenty-second Day of May, 2007

JON W. DUDAS
*Director of the United States Patent and Trademark Office*